US007748546B2

(12) United States Patent
Konstant

(10) Patent No.: US 7,748,546 B2
(45) Date of Patent: Jul. 6, 2010

(54) REINFORCED AND BOLTED RACK TRUSS

(75) Inventor: Anthony N. Konstant, Winnetka, IL (US)

(73) Assignee: Konstant Products, Inc., Skokie, IL (US)

( * ) Notice: Subject to any disclaimer, the term of this patent is extended or adjusted under 35 U.S.C. 154(b) by 405 days.

(21) Appl. No.: 11/437,288

(22) Filed: May 18, 2006

(65) Prior Publication Data

US 2007/0193190 A1 Aug. 23, 2007

Related U.S. Application Data

(63) Continuation-in-part of application No. 11/341,262, filed on Jan. 27, 2006.

(51) Int. Cl.
*A47B 57/00* (2006.01)
*E04C 3/02* (2006.01)
*E04H 12/00* (2006.01)

(52) U.S. Cl. ..... 211/191; 211/189; 52/693; 52/481.1; 52/655.1

(58) Field of Classification Search ..... 52/651.01, 52/651.07, 690, 693, 241, 653.1, 655.1; 211/176, 182, 187, 189, 190, 191, 148, 177, 211/134, 208, 192; 248/225.11, 223.41, 248/224.61, 220.21, 220.22, 240.2, 200, 248/300, 188.1, 677, 218.4, 219.4; 182/228.1
See application file for complete search history.

(56) References Cited

U.S. PATENT DOCUMENTS 532,983 A * 1/1895 Myer ..... 182/83
948,054 A * 2/1910 Hunt ..... 5/299
1,451,555 A * 4/1923 Schenstrom ..... 405/228
2,543,274 A * 2/1951 Bender ..... 211/70.4
2,776,030 A * 1/1957 Bush ..... 403/230
2,836,337 A * 5/1958 Thomas ..... 182/24
RE24,535 E * 9/1958 Franks ..... 211/191
2,892,661 A * 6/1959 French ..... 182/119
2,918,176 A * 12/1959 Bell et al. ..... 211/191
2,928,512 A * 3/1960 Slater et al. ..... 403/22
2,945,549 A * 7/1960 Gagnon ..... 182/120
3,072,262 A * 1/1963 Cassel ..... 211/191
3,102,641 A * 9/1963 Konstant et al. ..... 211/191
3,190,393 A * 6/1965 Alfano ..... 182/194
3,285,428 A * 11/1966 Scheck ..... 211/191
3,523,613 A * 8/1970 Konstant ..... 211/191
3,625,372 A * 12/1971 MacKenzie ..... 211/191
3,647,080 A * 3/1972 Denny ..... 211/191
3,664,513 A * 5/1972 Atwater ..... 211/134
3,905,483 A * 9/1975 Patrick ..... 211/190
4,007,570 A * 2/1977 Hunter ..... 52/317
4,048,059 A * 9/1977 Evans ..... 108/155
4,078,664 A * 3/1978 McConnell ..... 211/189
4,088,229 A * 5/1978 Jacoby et al. ..... 211/191
4,616,453 A * 10/1986 Sheppard et al. ..... 52/93.1
4,678,091 A * 7/1987 Konstant et al. ..... 211/191
4,687,404 A * 8/1987 Seiz et al. ..... 414/276
5,310,066 A * 5/1994 Konstant ..... 211/193

(Continued)

*Primary Examiner*—Robert J Canfield
*Assistant Examiner*—Babajide Demuren
(74) *Attorney, Agent, or Firm*—Niro, Haller + Niro

(57) ABSTRACT

A rack truss for use in forming shelf-type storage racks which may be assembled at the site using bolts and/or which includes reinforcement at the lower level of the rack truss.

4 Claims, 15 Drawing Sheets

U.S. PATENT DOCUMENTS 5,316,157 A * 5/1994 Konstant ..... 211/151
5,369,925 A * 12/1994 Vargo ..... 52/244
5,749,481 A * 5/1998 Miller ..... 211/191
5,943,838 A * 8/1999 Madsen et al. ..... 52/846
5,946,867 A * 9/1999 Snider et al. ..... 52/167.1
6,186,725 B1 * 2/2001 Konstant ..... 414/276
6,189,277 B1 * 2/2001 Boscamp ..... 52/317
6,199,336 B1 * 3/2001 Poliquin ..... 52/489.1
6,298,537 B1 * 10/2001 Dion ..... 29/402.06
6,481,582 B1 * 11/2002 Rinderer ..... 211/26
6,604,640 B1 * 8/2003 Jehin ..... 211/191
6,609,621 B2 * 8/2003 Denny et al. ..... 211/189
6,691,880 B2 2/2004 Konstant
6,776,298 B2 * 8/2004 Courtwright ..... 211/191
7,490,806 B2 * 2/2009 Rioux ..... 248/345.1
2003/0010739 A1 * 1/2003 Konstant ..... 211/189
2003/0122042 A1 * 7/2003 Williams, Jr. ..... 248/188.1

* cited by examiner

REINFORCED AND BOLTED RACK TRUSS

This application is a continuation-in-part of U.S. patent application Ser. No. 11/341,262 filed on Jan. 27, 2006.

BACKGROUND OF THE INVENTION

The present inventions relate generally to improved shelf-type storage racks. More particularly, the present inventions relate to rack trusses that are bolted together for ease of shipment and assembly and/or which are reinforced at the bottom to prevent damage to the trusses by, among other things, lift trucks during loading or unloading.

Shelf-type storage racks are well known in the storage and warehouse industries. Such racks typically include at least four columns, two in the front or access aisle and two in the back. Lateral beams interconnect the pairs of front columns and pairs of back columns. The lateral beams, in conjunction with optional cross members between the lateral beams, form shelves used for storage of pallets and their loads. Typically, there is a shelf approximately 48 inches from the ground and then shelves above the lowest shelf spaced approximately every 48 inches, or for other loads at load required increments.

Each pair of front and back columns are provided with transverse support beams that interconnect the front and back columns. Diagonal support braces between the front and back columns may also be provided for increased strength, rigidity and stiffness. Each pair of front and back columns and the associated beams and braces are typically referred to in the industry as rack trusses. Each pair of opposing rack trusses, and their interconnecting lateral beams, form a typical shelf-type storage rack. The racks may be placed side-by-side and/or back-to-back in arrays to form the desired storage rack system.

The components that form the storage rack trusses, such as the transverse supports and diagonal support braces, are typically welded together and painted at the fabrication site and then shipped to the storage facility where they are installed for use. For example, the transverse supports and any diagonals are typically welded to the front and back columns to form the rack truss. Once at the storage facility, the lateral beams interconnecting each opposing pair of trusses are installed by welding or bolting (see e.g., U.S. Pat. No. 4,678,091). The bottom of the columns of the rack trusses may be placed directly on the warehouse floor. Because the trusses are fabricated prior to shipping and installation, known rack trusses are somewhat difficult to handle during assembly, take-up more space during shipping and can be difficult to paint. In addition, because the rack trusses are welded prior to shipment and assembly, the truss components cannot be easily replaced if damaged after installation.

In use, the pallets and their loads are placed on or removed from the shelves using a fork lift truck. Experience has shown that the bottom portion of the rack truss and particularly, the bottom 4-6 inches of the truss, take the most abuse. For example, the bottom portion of the front columns at the access aisle, are often bumped by pallets or the forks of a lift truck during the placement or removal of pallets and their loads. This can result in, among other things, a weakened rack structure.

SUMMARY OF THE INVENTION

The present inventions preserve the advantages of known storage racks and storage rack trusses and also provide new features and advantages. For example, the present inventions provide storage racks and rack trusses that may be bolted together at the site making shipping and assembly more efficient and/or which provide reinforcement in the lower portion of the truss to resist abuse from forks of fork trucks and the like.

In a preferred embodiment of the present invention, a bolted truss for use in forming storage racks is provided having at least one front column having an interior face and at least one rear column having an opposing interior face. The invention also includes a plurality of stubs secured (by bolting or welding) to the interior face of the front column and a series of stubs secured (by bolting or welding) to the interior face of the rear column, as well as a plurality of transverse beams having a front and back end which are placed between the front and rear columns. The front end of the transverse beam is bolted to the stub on the front column and the rear end is bolted to the stub on the rear column. The preferred stubs may also have a vertical member on approximately the centerline of the front and/or rear column when connected thereto and to which the transverse beams and any diagonals may be attached. In addition, in a preferred embodiment, the stubs may be removably secured to said columns by bolts or the like. A foot that is secured (by bolting or welding) to the bottom of said columns may also be provided.

In yet another preferred embodiment of the present invention, a bolted storage rack truss system is provided with at least one front column having an interior face and a series of holes through said face, and at least one rear column having an opposing interior face and a series of holes through said face. The invention also includes a plurality of transverse beams having a front and back end which are placed between the front and rear columns, the front end of the transverse beam being adapted to be secured to the front column through the holes on the front column and the rear end of the transverse beam being adapted to be secured through the holes on the rear column. In addition, a preferred embodiment of the present invention may provide that the transverse beams are bolted or otherwise removably secured directly to the columns.

In another embodiment of the present invention, a bolted truss for use in forming storage racks is provided including at least one front column having an interior face and at least one rear column having an opposing interior face. A plurality of stubs secured to the interior face and a flange of the front column and a series of stubs similarly secured to the interior face and a flange of the rear column, with the stubs on the front and rear columns opposing each other. The embodiment may also include a plurality of transverse beams having a front and back end which are placed between the front and rear columns, the front end of which is bolted to the stub on the front column and the rear end of which is bolted to the opposing stub on the rear column. The stubs and transverse beams may be formed of structural angles. In addition, at least one diagonal brace may also be provided which is attached to the stubs. A preferred embodiment of the present invention may also include a truss reinforcement means.

Another preferred embodiment of the present inventions is a reinforced truss for use in storage racks including at least one front column having an interior face and at least one rear column having an opposing interior face. The preferred embodiment also includes a horizontal locking tab secured to the inside face of the front column and a vertical locking tab spaced rearwardly from said front column; a horizontal locking tab secured to the inside face of the rear column; and, a horizontal stiffening member including a front end and a rear end, having a vertical support leg spaced rearwardly from the front end, the front end of the horizontal stiffening member capable of being bolted to the horizontal locking tab of the front column, and the rear end capable of being bolted to the horizontal locking tab on the rear column, and the vertical support leg capable of being bolted to the vertical locking tab. The preferred embodiment may also include a vertical locking tab on the rear column and a vertical support leg on the rear end of horizontal support leg such that the rear vertical support leg may be bolted to the rear vertical locking tab. This preferred embodiment may also include means for assembling the truss using bolts.

Accordingly, it is an object of the present inventions to provide a rack truss, all or portions of which may be assembled by bolts or other on site fastening means.

Another object of the present inventions to provide a rack truss that provides reinforcement of the columns at the lower portion of the truss.

Additional object of the present inventions is to provide a rack truss that is assembled using bolts and/or which provides reinforcement of the columns at the lower portion of the truss.

Yet another object of the present inventions is to provide a bolted truss that self-aligns during assembly of the upright portion of the truss.

Yet an additional object of the present inventions is to provide a bolted and/or reinforced rack truss that can be used for drive-in rack systems.

Still another object of the present inventions is to provide a bolted and/or reinforced rack truss that can be used for push-back rack systems.

A still further object of the present inventions is to provide a rack truss having stubs that may be removably secured to the columns for on site assembly or welded thereto.

Yet a further object of the present invention is to provide a bolted and/or reinforced rack truss, the shelves of which may be vertically spaced from each other as appropriate for the particular storage situation, particularly when the stubs are bolted to the columns as permitted by on site assembly.

Yet an additional object of the present invention is to provide feet or bases for the columns that may be removably secured for on site assembly or welded thereto.

Yet still another object of the present invention is to provide stubs having vertical faces to which the transverse beams and any diagonals may be secured.

Yet still a further object of the present invention is to provide transverse beams that may be bolted or otherwise removably secured to the columns, without the need for stubs.

A further object of the present inventions is to provide a rack truss that is easy to fabricate, paint, ship, assemble and install.

INVENTOR'S DEFINITION OF THE TERMS

The terms used in the claims of this patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The stated and unstated features and advantages of the present inventions will become apparent from the following descriptions and drawings wherein like reference numerals represent like elements in the various views, and in which.

DETAILED DESCRIPTION OF PREFERRED EMBODIMENTS

Set forth below is a description of what is currently believed to be the preferred embodiments or best representative examples of the inventions claimed. Future and present alternatives and modifications to the embodiments and preferred embodiments are contemplated. Any alternatives or modifications which make insubstantial changes in function, purpose, structure or result are intended to be covered by the claims of this patent.

Figure 1:
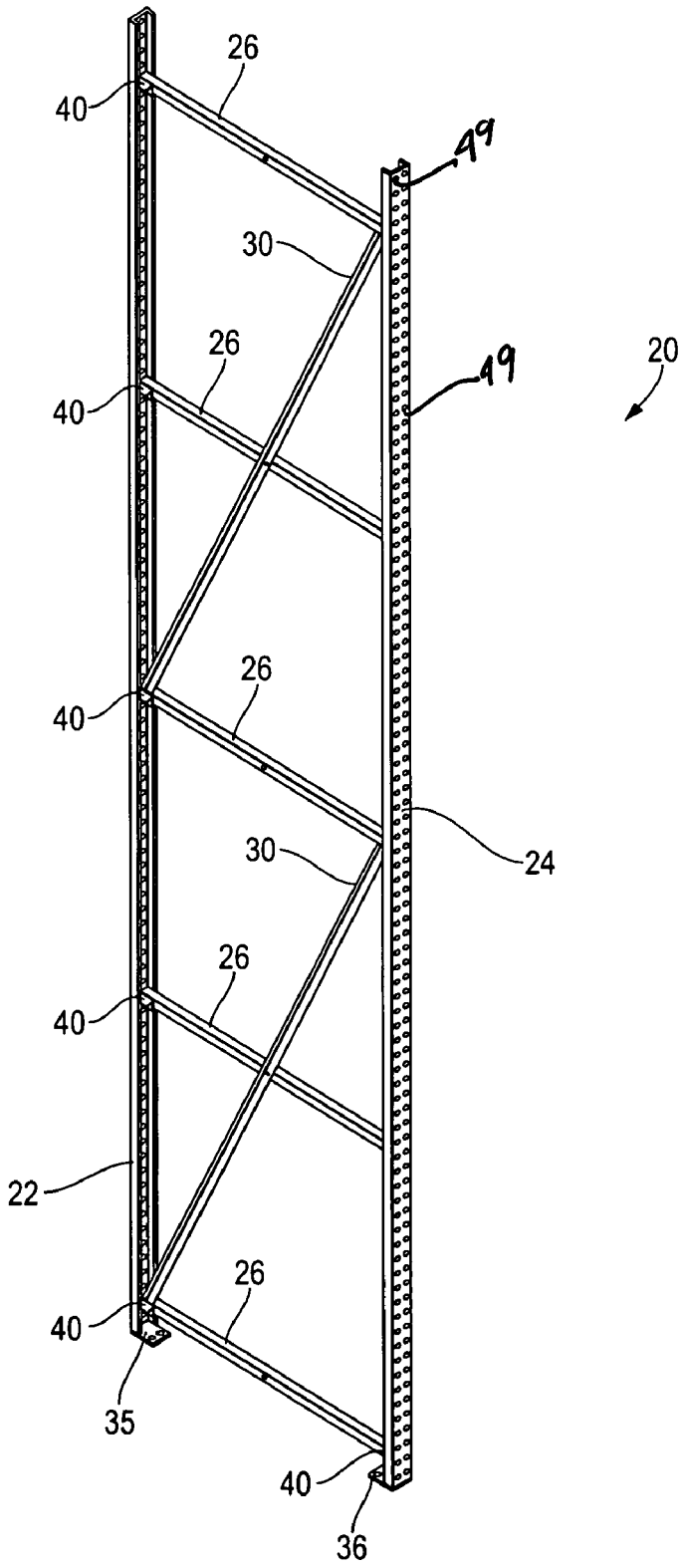
FIG. 1 is a rear perspective view of a preferred embodiment of a bolted rack truss of the present invention.

A preferred embodiment of the bolted truss of the present invention is shown generally as 20 in FIG. 1. The preferred components of preferred truss 20 are shown in FIGS. 1-6 and 11-16. A preferred embodiment of the lower truss reinforcement of a bolted truss 20 is shown generally as 50 in FIG. 7. Preferred components of preferred lower reinforcement 50 are shown in FIGS. 7-10. It will be understood by those of skill in the art that bolted truss 20 inventions may be used alone or in combination with truss reinforcement inventions 50. Similarly, truss reinforcement inventions 50 may be used alone or in combination with the bolted truss 20 inventions.

By reference to FIGS. 1-6, 12-14 and 16, bolted truss 20 includes a front column 22 and a rear column 24. A plurality of transverse beams 26 and diagonal braces 30 are also provided between front column 22 and rear column 24. In the preferred embodiment, columns 22 and 24 are made from structural channels having a web 21 and flanges 23 and 25. A series of holes 49 may also be provided on columns 22 and 24 to which stubs 40 may be bolted or otherwise attached as hereinafter described (see e.g., FIGS. 1-2 and 5-9). Alternatively, the ends of transverse beam 26 may be modified as hereinafter described (see FIGS. 16A-B), so that they may be bolted to columns 22 and/or 24. Finally, holes 49 may also be used to secure the lateral beams (not shown) between columns.

Figure 15C:
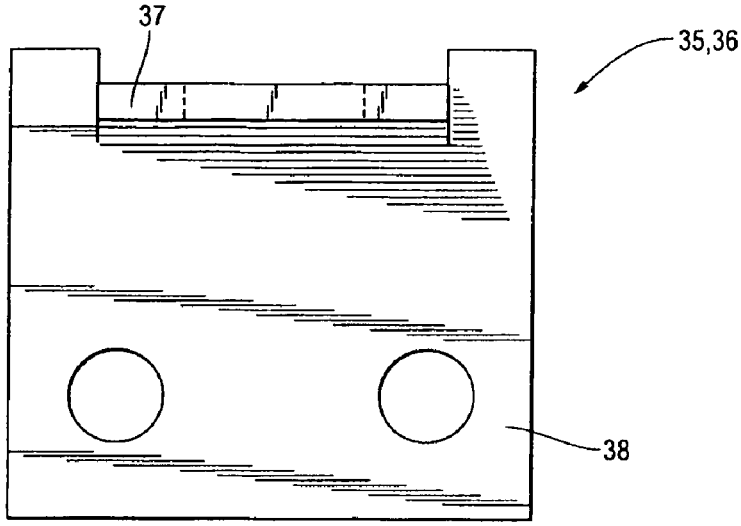
FIG. 15C is a top view of the foot of FIG. 13A.
Figure 15A:
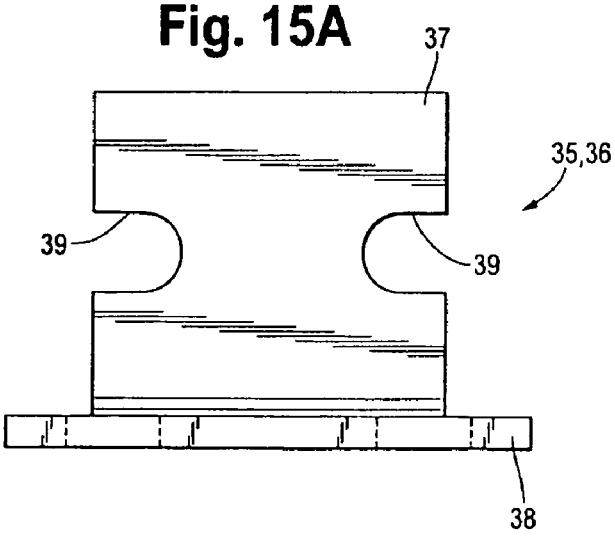
FIG. 15A is a front view of an alternative preferred embodiment of a foot of the present invention.
Figure 15B:
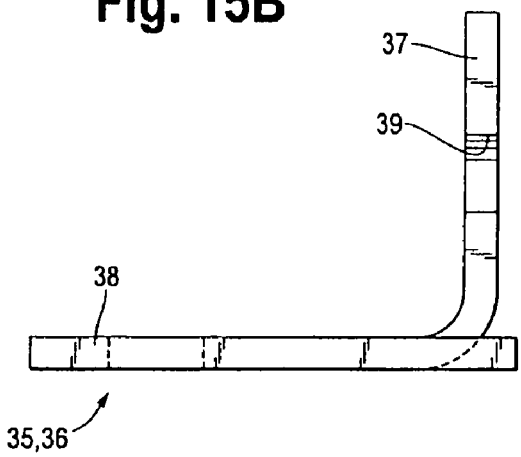
FIG. 15B is a side view of the foot of FIG. 13A.

The bottom of front column 22 may be provided with a foot 35 and the bottom of rear column 24 may also be provided with a foot 36. Feet 35 and 36 may be used to secure truss 20 to the floor and may also be incorporated into the truss reinforcement 50 inventions, as hereinafter described. An alternative embodiment of feet 35/36 is shown in FIGS. 15A, 15B and 15C, which may be bolted or otherwise secured to the bottom of columns 22 and/or 24. It will be understood by those of skill in the art that a wide variety of structural members may be used to practice the present inventions. The above described components are typically bolted together as hereinafter described to form bolted truss 20, although some components, such as stub 40, may be welded to columns 22 and 24, if desired or appropriate for the application.

Figure 2:
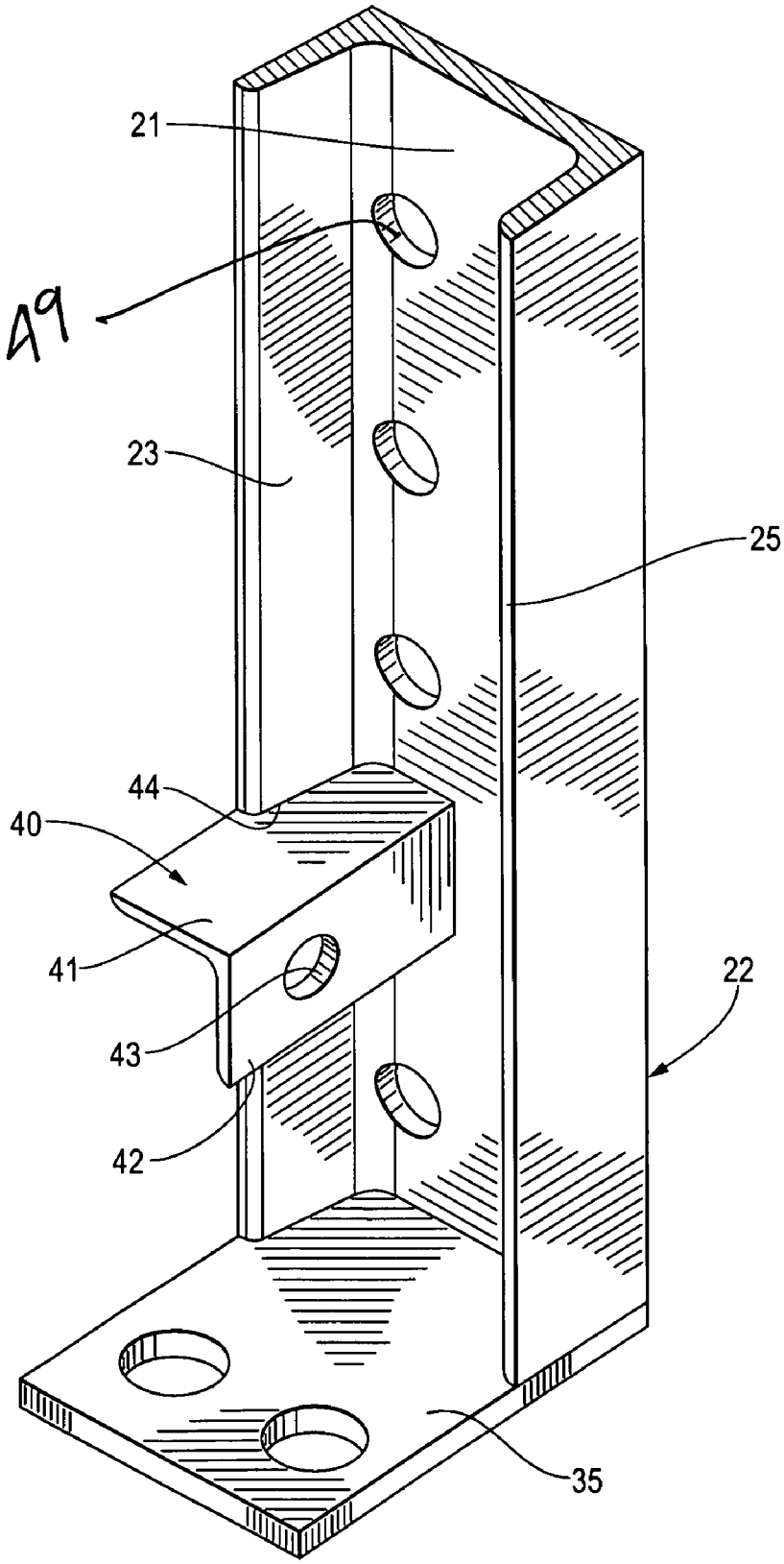
FIG. 2 is a rear perspective view of an embodiment of a stub of an embodiment of the present invention shown on the bottom portion of the front column of the truss.
Figure 3:
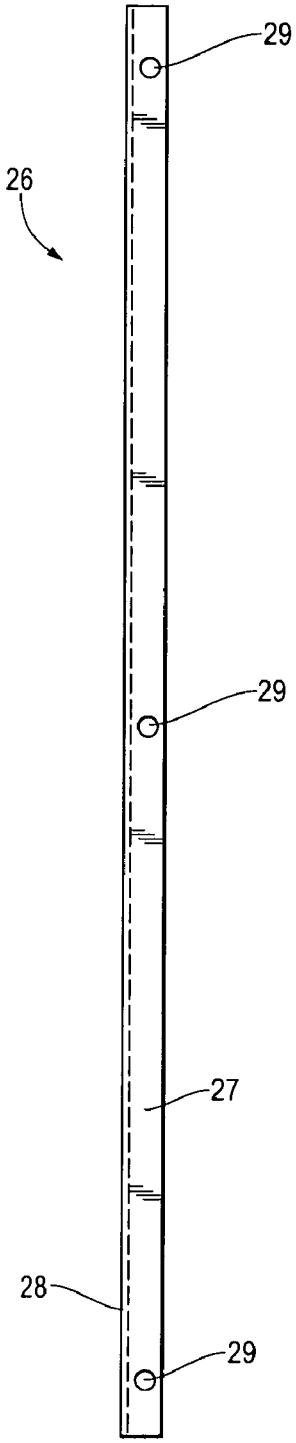
FIG. 3 is a side view of a preferred embodiment of a transverse beam of the present invention.
Figure 4:
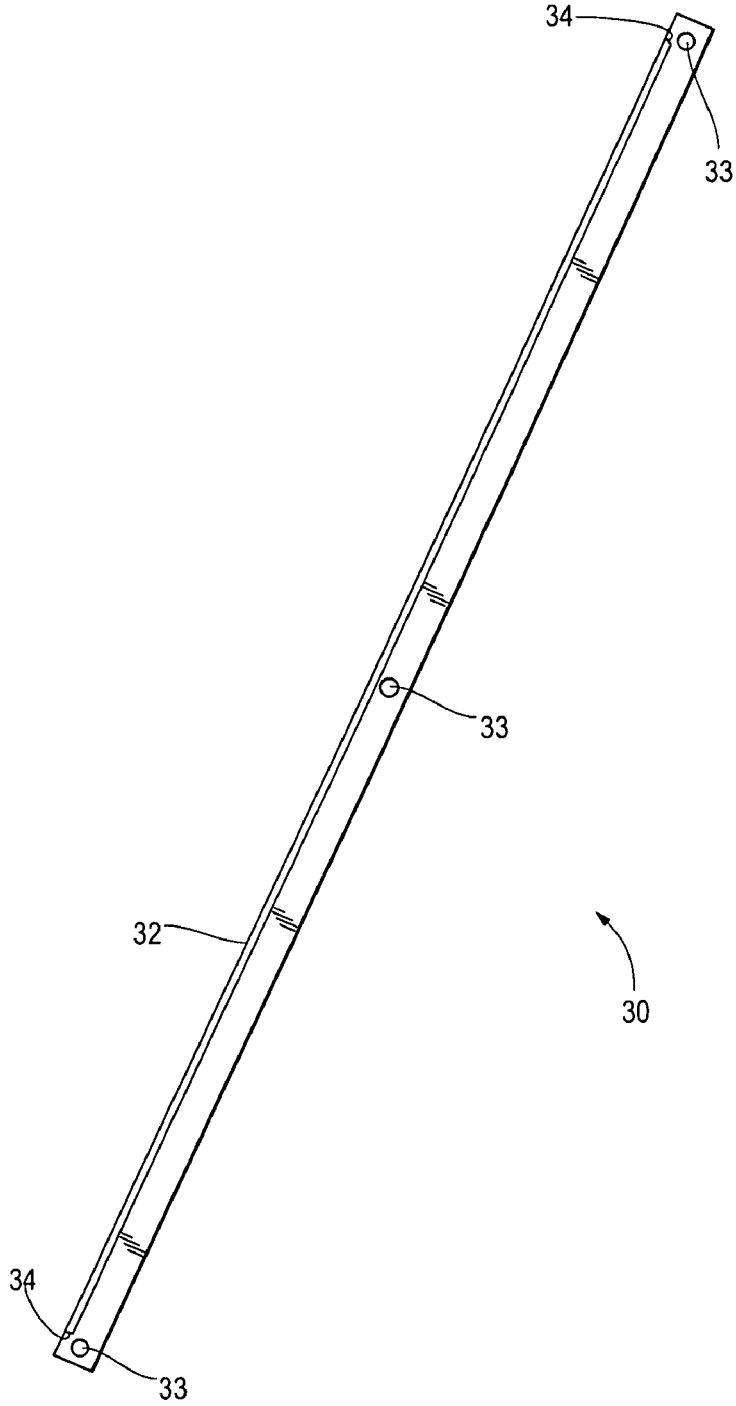
FIG. 4 is a side view of a preferred embodiment of a diagonal brace of the present invention.
Figure 5:
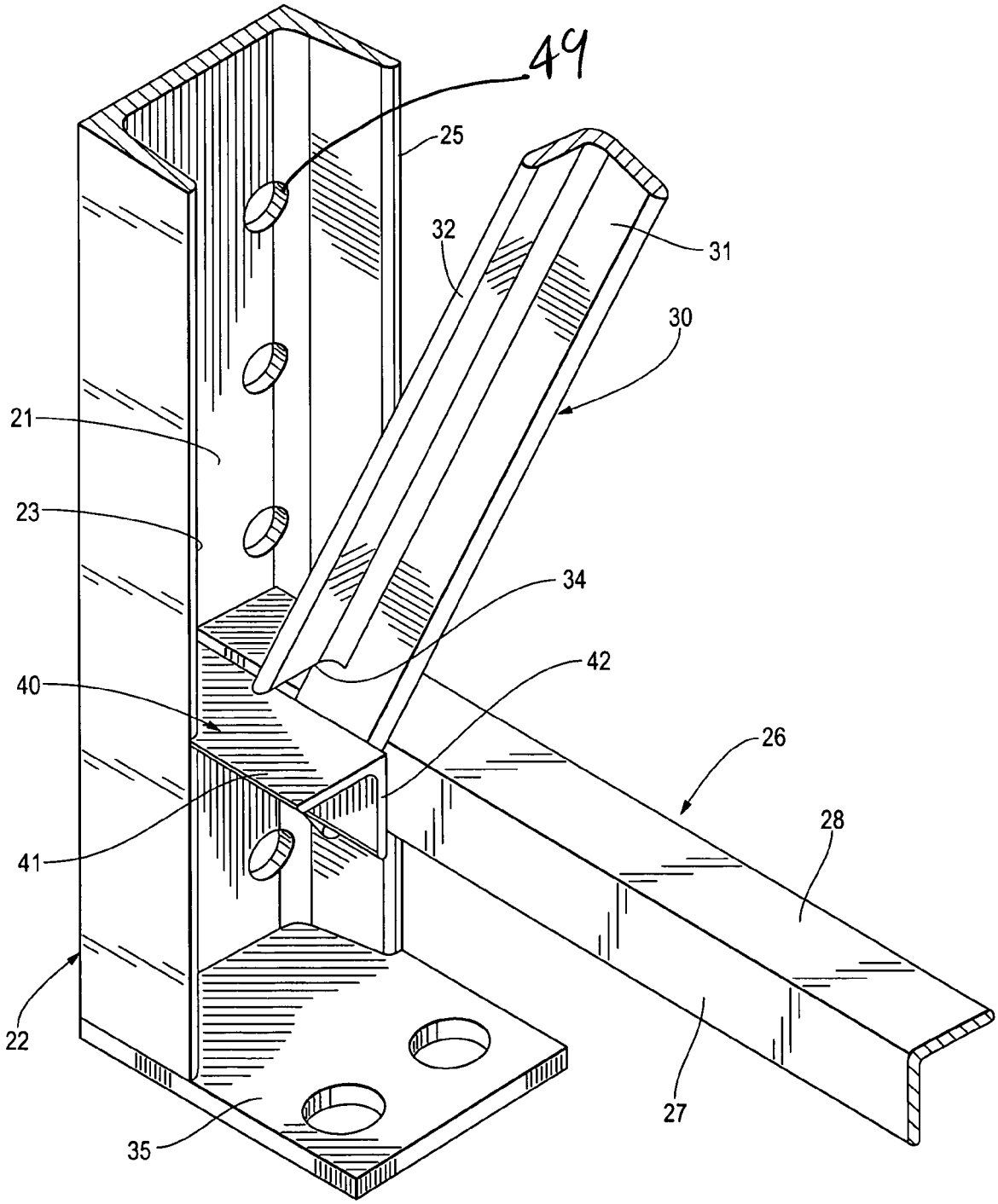
FIG. 5 is a rear perspective view of an embodiment of a stub of the present invention shown on the base portion of the front column of the truss with a preferred embodiment of a transverse beam and diagonal brace shown in the installed position.
Figure 6:
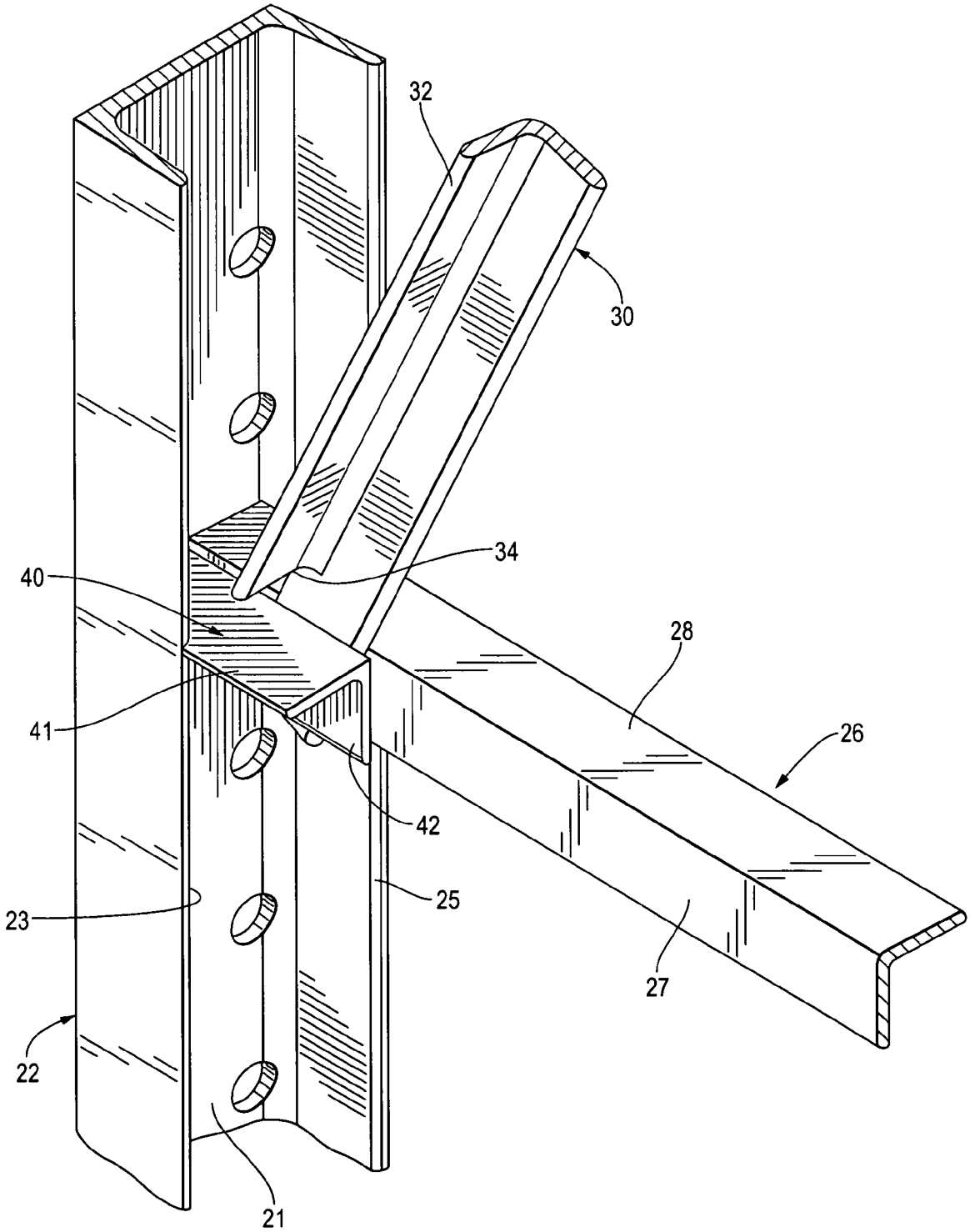
FIG. 6 is a rear perspective view of an embodiment of a stub of the present invention shown on an intermediate portion of the front column with a preferred embodiment of a transverse beam and diagonal brace shown in an installed position.
Figure 7:
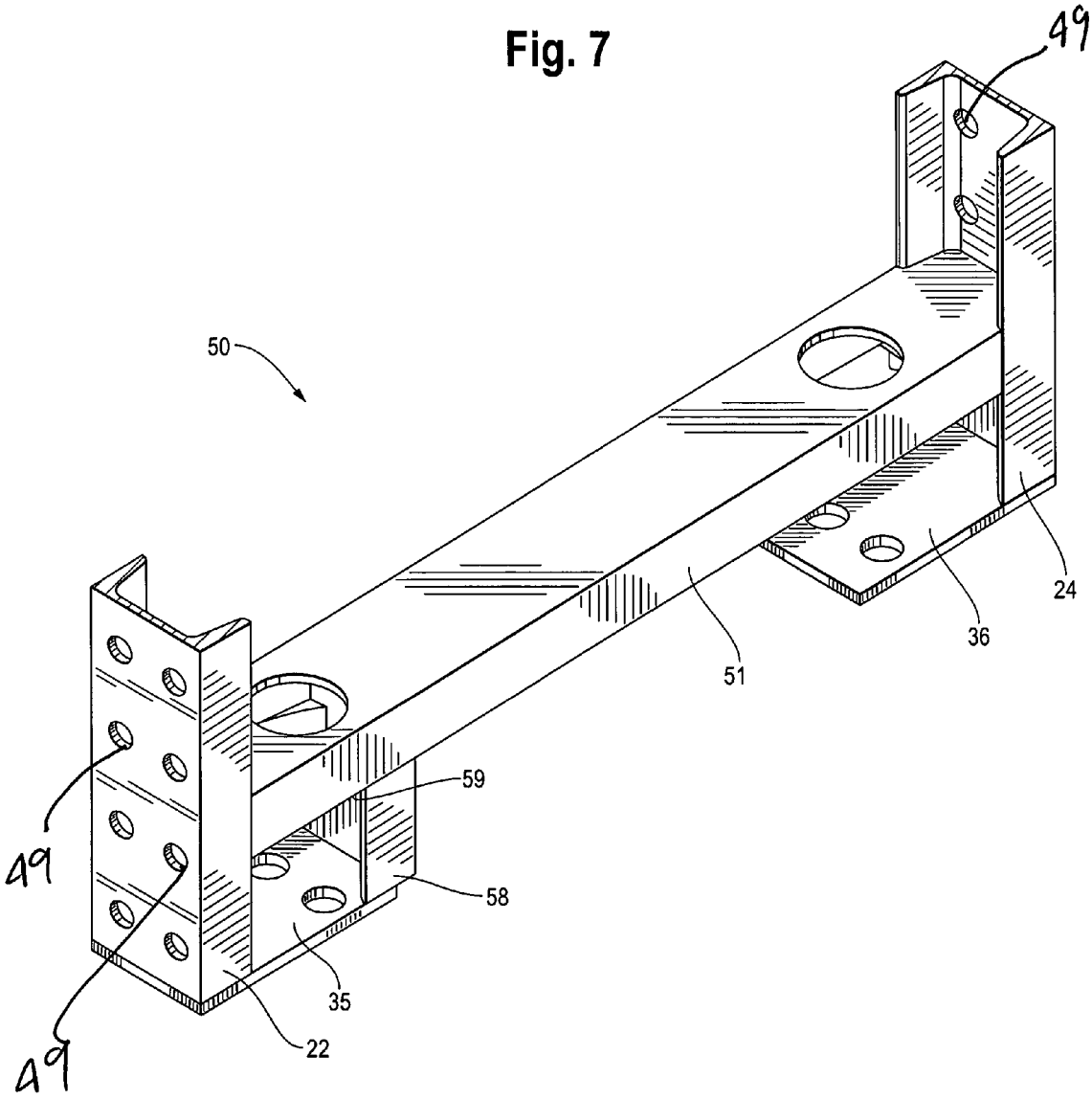
FIG. 7 is a side perspective view of a preferred embodiment of a truss reinforcement of the present invention shown installed at the bottom of the truss between the front and back columns.

In one embodiment, a series of stubs 40 are provided on the inside face of front column 22. Rear column 24 is also provided with a series of stubs 40 which are mounted on the opposing inside face of rear column 24. As shown in FIGS. 2, 5 and 6, stub 40 is welded or otherwise secured to the interior of front column 22 along flange 23 and web 21. Stubs 40 on rear columns 24 are similarly mounted. In one embodiment, stubs 40 are formed from structural angles having a horizontal leg 41 and a vertical leg or face 42, which is provided with a hole 43. The horizontal leg 41 of stub 40 is notched 44 so that it can be securely attached to the inside surface of flange 23 of column 22 by welding or other well known means.

Similarly, the interior of rear column 24 is provided with a series of stubs 40 that oppose, either at the same or different elevation from the floor depending upon the type and spacing of shelves desired, stubs 40 on front column 22. Stubs 40 on front column 22 and rear column 24 are used to secure transverse beams 26 as well as diagonal braces 30, as hereinafter described. Again, it will be understood by those of skill in the art that stubs 40 may be formed from a wide variety of structural components, as well as formed from plating and the like, consistent with the inventions.

Figure 12C:
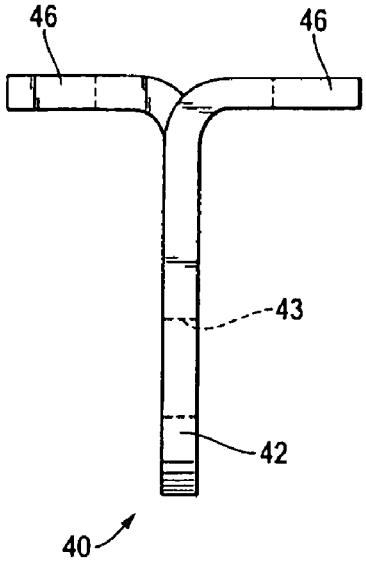
FIG. 12C is a top view of a preferred embodiment of a stub of FIG. 12A.
Figure 12A:
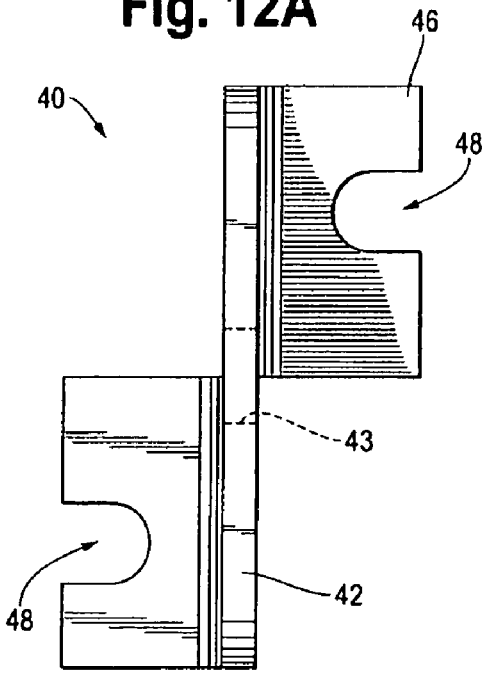
FIG. 12A is a front view of a preferred embodiment of a stub of the present invention.
Figure 12B:
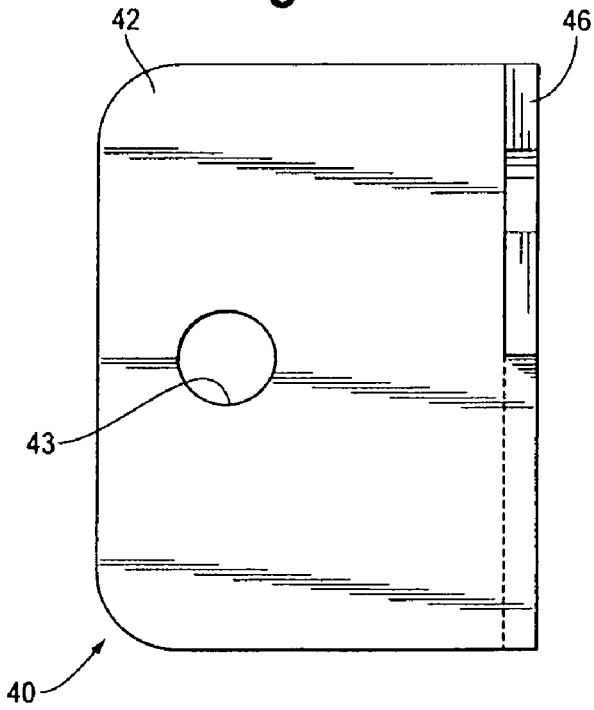
FIG. 12B is a side view of a preferred embodiment of a stub of FIG. 12A.

For example, in the preferred embodiment, shown in FIGS. 12A, 12B and 12C, stub 40 includes a vertical face or member 42 having a hole 43. Support legs 46, having slots 48 are also provided. In this embodiment, the support legs 46 of stub 40 may be bolted to the interior face of web 21 of column 22 through slots 48 on supports legs 46 and holes 49 through column 22. Alternatively, support legs 46 may be welded to web 21 and/or flange 23 as appropriate under the circumstances. When installed, stub 40 provides a vertical member 42 having a hole 43 to which transverse beam 26 and any diagonal brace 30 may be secured. In this manner, it is typically not necessary to notch or modify the ends of transverse beam 26 and/or diagonal brace 30. It will be understood by those of skill in the art that the embodiment of stub 40 shown in FIGS. 12A-C may be formed from a plate that is cut and bent to the desired shape. Stub 40 is attached to rear column 24 in the same manner as described for front column 22.

Figure 13A:
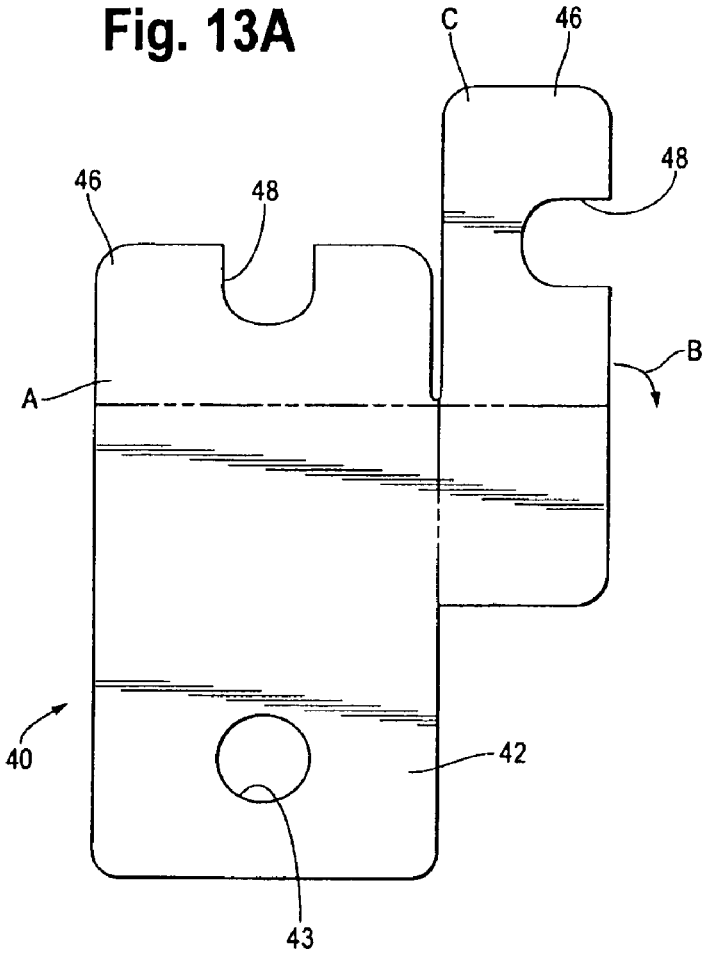
FIG. 13A is a top plan view of an unformed blank of an alternative preferred embodiment of a stub of the present invention, the embodiment being particularly useful in applications where it is to be bolted to the column.
Figure 13B:
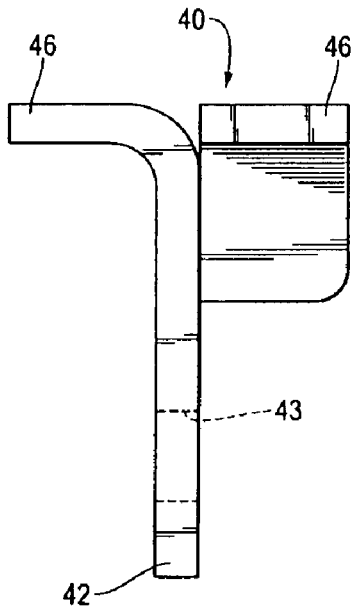
FIG. 13B is a top view of a formed stub of the embodiment of FIG. 13A.
Figure 14C:
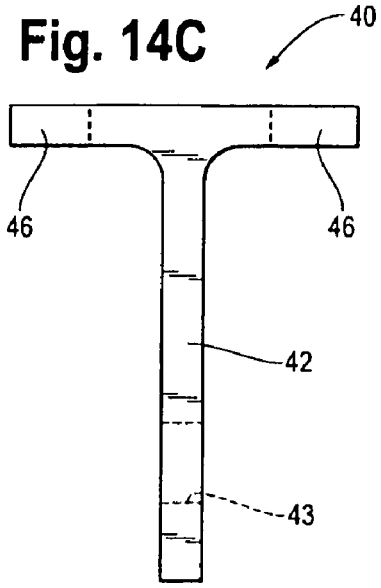
FIG. 14C is a top view of the stub of FIG. 14A.
Figure 14A:
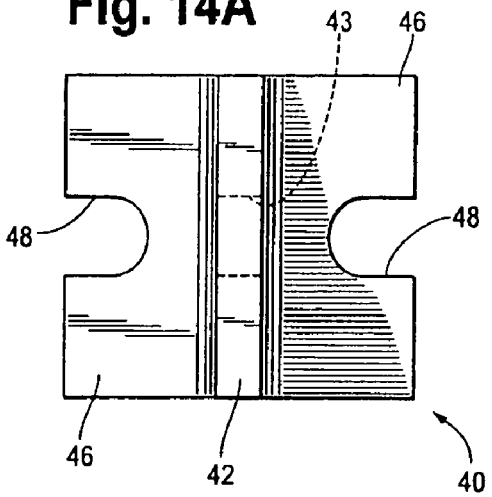
FIG. 14A is a front view of another preferred stub embodiment of the present inventions.
Figure 14B:
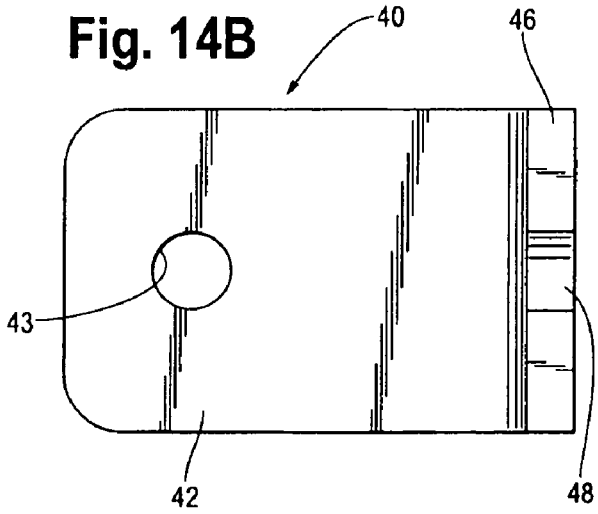
FIG. 14B is a side view of the stub of FIG. 14A.

Another preferred embodiment of stub 40 is shown in FIGS. 13A and 13B. Unlike the embodiment of FIGS. 12A-C, this embodiment does not have offset support legs 46. In this embodiment, a plate is cut in the shape shown in FIG. 13A. Tab A is then bent at approximately 90° into the page of FIG. 13A, Tab B is bent at approximately 90° out from the page of FIG. 13B, and then Tab C is bent approximately 90° in the opposite direction of Tab A. The result is a stub 40 as shown from the top in FIG. 13B. The resulting stub 40 may be bolted or welded to columns 23 and 24 as desired. This embodiment is particularly useful for attachment with bolts. Yet another embodiment of stub 40 is shown in FIGS. 14A, 14B and 14C. This embodiment is cut from a structural member, such as a wide flange. It may be bolted or welded to columns 22 and 24 as desired. It will be understood by those of ordinary skill in the art that other embodiments of stub 40 are acceptable in accordance with the present inventions.

Preferred transverse beam 26 is formed from a structural angle having a vertical leg 27 and a horizontal leg 28. A series of holes 29 are provided, one in the center and one at each end (see FIG. 3). Diagonal brace 30 is also preferably formed from a structural angle. It includes a vertical flange 31, a horizontal flange 32 and three holes 33, one at each end and one in the center. The horizontal flange 32 of each end of brace 30 has a notch 34 in the horizontal flange 32 so that it may be secured to stub 40. However, depending upon the embodiment of stub 40 desired, it may not be necessary to notch or otherwise modify transverse beam 26.

Figure 16A:
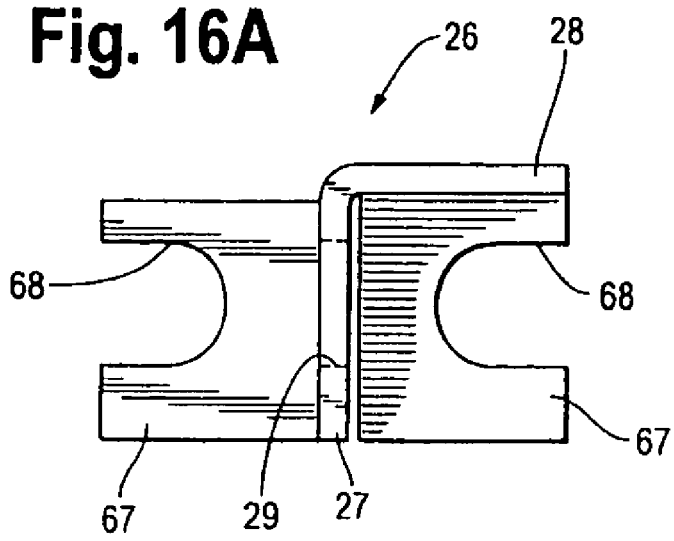
FIG. 16A is a front view of an end of a preferred embodiment of a transverse beam of the present invention, the embodiment being particularly useful in applications where no stub is used to secure the transverse beam.
Figure 16B:
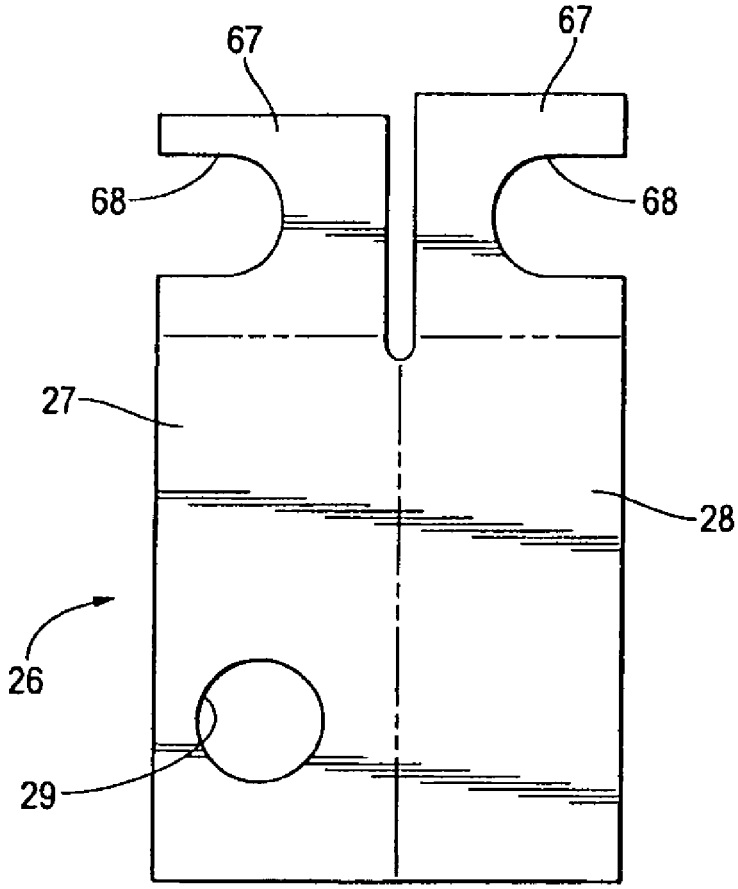
FIG. 16B is a top plan view of an unformed blank of an end of the preferred transverse beam of FIG. 16A.

In addition, another preferred embodiment of the present invention may be provided that does not require the use of stubs 40. As shown in FIGS. 16A and 16B, the end or ends of the transverse beam 26 may be modified so that it may be connected directly to, for example, the web 21 of front column 22 and/or rear column 24. As shown in FIG. 16A, either or both ends of transverse beam 26 may be provided with tabs 67 having holes or slots 68. Transverse beam 26 may then be bolted or otherwise secured to front column 22 and/or rear column 24 through the holes 49 in web 21 and slots 68 of tabs 67.

A preferred embodiment of transverse beam 26 and its end(s) may be formed using a plate, an end of which is shown in FIG. 16B. As shown in FIG. 16B, one way to form the right tab 67 on the right side is to fold tab 67 into the page by approximately 90° and folding the left tab 67 approximately 90° out of the page along the dotted line. Leg 28 of transverse beam 26 is then bent approximately 90° into the page, with the result being preferred end as shown in FIGS. 16A-B. It will be understood by those of ordinary skill in the art that the end of transverse beam 26 may be formed in a variety of ways or may be cut from structural members. In the embodiment shown, a hole 29 is provided in vertical member 27 so that a diagonal brace 30 may be attached thereto.

As a result of the unique aspects of the present invention, the truss components, such as columns 22 and 24 and their associated stubs 40, transverse beams 26 and/or diagonal brace 30 may be fabricated and shipped to the site prior to assembly. Once at the site, transverse beams 26 are installed between front and back columns 22 and 24 by bolting one end of transverse beam 26 to stub 40 on the front column 22 through holes 43 on stub 40 and holes 29 at one end of transverse beams 26. The other end of transverse beams 26 is attached to stub 40 of rear column 24 in the same way. Preferably, vertical leg 42 of stub 40 is parallel to and faces vertical leg 27 of transverse beams 26 (see FIGS. 5 and 6). Alternatively, depending upon the embodiment of stub 40 that is used, it too may be bolted to columns 22 and 24 at the site or welded to the columns prior to shipment. Or as yet another alternative, transverse beam 26 may be bolted to front and/or rear columns 22/24 as shown in FIGS. 16A-B. The embodiments having the stubs 40 or transverse beams 26 bolted to columns 22 and/or 24 are particularly useful in situations, among others, where it may be desirable to vary shelf height, etc.

Diagonal brace 30 may be installed on a stub 40 of front column 22 and a stub 40 that is two stubs 40 higher in on back column 24 as shown in FIG. 1. One end of diagonal brace 30 is secured between vertical leg 42 of stub 40 and vertical leg 27 of transverse beam 26 using a bolt through holes 43, 33 and 29 of the respective members. Notch 34 on horizontal flange 32 of diagonal brace 30 enables the horizontal flange 32 to clear the horizontal leg 41 of stub 40. The other end of diagonal brace 30 is attached to stub 40 of rear column 24 in the same manner. The center of diagonal brace 30 is then attached to the center of the next higher transverse beam 26 using a bolt through center holes 33 of diagonal brace 30 and center holes 29 of transverse beam 26 (see FIG. 1).

In a preferred form of installation and structural components (horizontal flange 41 of stub 40, one end of vertical flange 31 of diagonal brace 30 and horizontal flange 28 of transverse beam 26), the entire interior face between flanges 23 of front and rear columns 22 and 24 is filled (see e.g., FIG. 6). This configuration provides increased strength. It also reduces the potential for twisting of the components.

Figure 11:
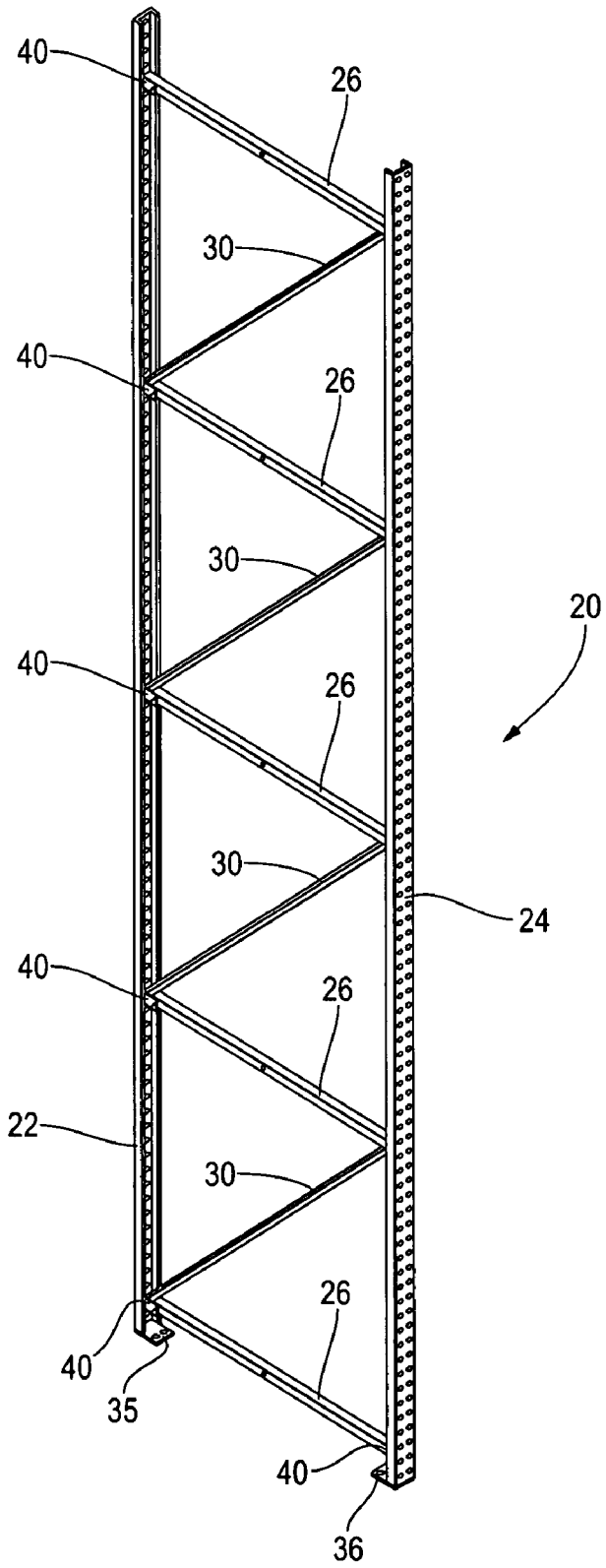
FIG. 11 is a rear perspective view of a preferred embodiment of the bolted truss of the present invention showing an alternative embodiment of a diagonal brace of the present invention.

A preferred alternative to the above arrangement of diagonal brace 30 is also appropriate and is shown in FIG. 11. In this embodiment, a diagonal brace 30 is provided diagonally between each pair of transverse beams. For example, one end of diagonal brace 30 is secured on a stub 40 of front column 22 as described above. The other end of diagonal brace 30 is attached to the next higher stub 40 of rear column 24, also in the same manner as described above. Of course, in this embodiment, there is no need for center holes 33 of diagonal brace 30 or center holes 29 of transverse beam 26.

The bottom of columns 22 and 24 may be provided with feet 35 and 36. A preferred embodiment of feet 35/36 is shown in FIGS. 15A-C. In this embodiment, an upright 37 is provided that may include slots 39. A base portion 38 is provided which is at an approximately 90° angle to upright 37. Base 38 may include holes for attachment to the floor. Preferred feet 35/36 may be secured by welding to the inside faces of columns 22/24 or may be bolted thereto using slots 39 or other apertures. Thus, preferred feet 35/36 may be installed prior to shipment or at the site. It will be understood by those of skill in the art that foot 35 and/or 36 may be formed from a variety of materials and/or take on a variety of configurations consistent with the present inventions.

A preferred embodiment of the truss reinforcement 50 inventions may generally be seen by reference to FIGS. 7-10. Truss reinforcement 50 includes a stiffening beam 51 formed from a structural channel having a horizontal web 52 and two vertical flanges 53. A hole 54 is provided on the front end of stiffening beam 51 and a hole 55 is provided on the back end of stiffening beam 51 to function as hereinafter described. A vertical support leg 56 is attached to the underside of stiffening beam 51 generally toward the front of member 51. Vertical support leg 56 is formed from a structural channel member having a web 57 and two flanges 58. A hole 59 is provided on web 57 to function as hereinafter described.

Figure 8:
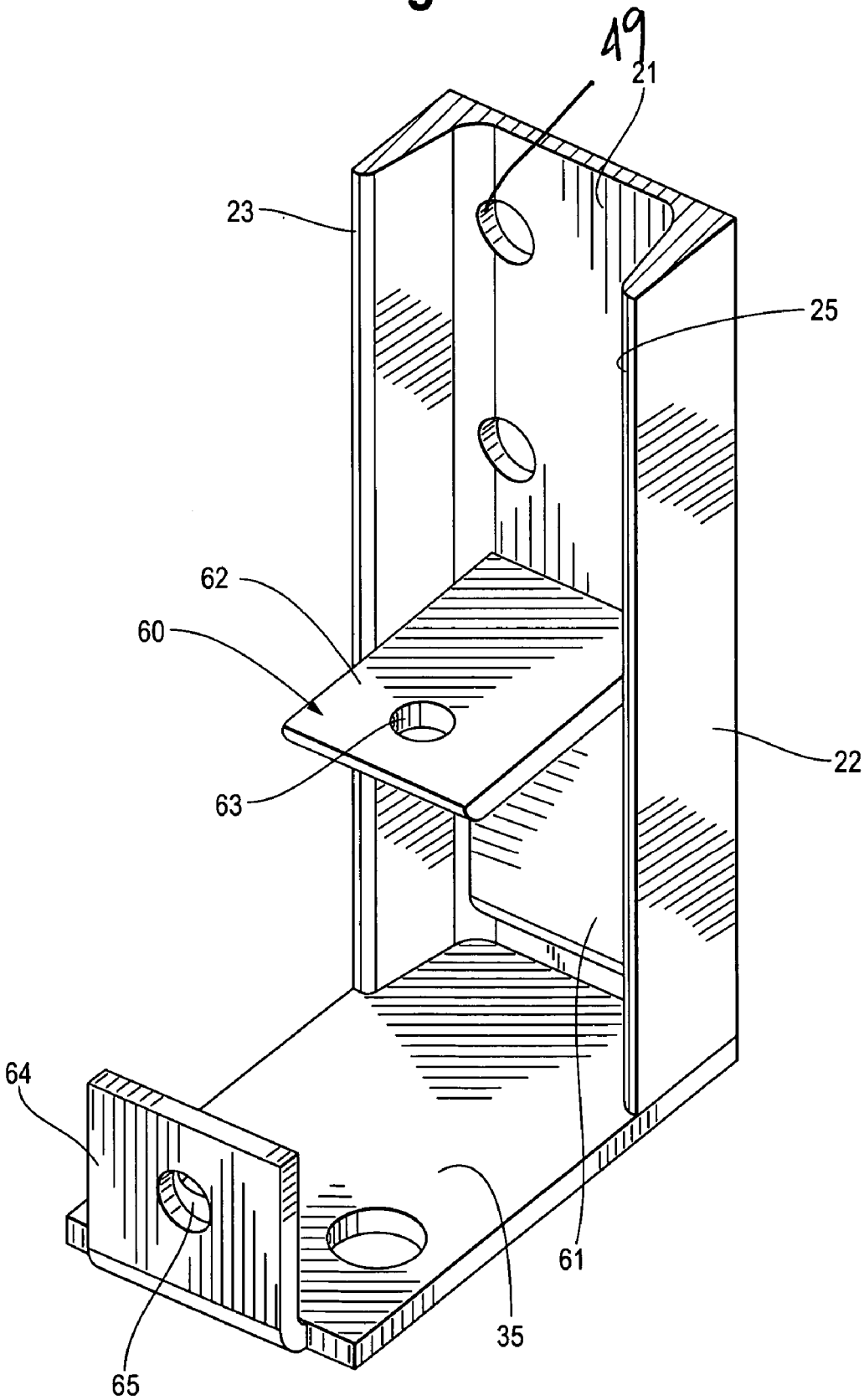
FIG. 8 is a rear perspective view of the front portion of a preferred embodiment of the truss reinforcement of the present invention.

The bottom of front column 22 is provided with a horizontal locking tab 60 (see FIG. 8). In a preferred embodiment, horizontal locking tab 60 is made from a piece of a structural angle having a vertical flange 61 and a horizontal flange 62. Vertical flange 61 is welded to the inside of web 21 of front column 22 between flanges 23 and 25. Horizontal flange 62 is provided with a hole 63 that is designed to mate with hole 54 on the front stiffening member 51.

A vertical locking tab 64 is also provided in association with front column 22. Vertical locking tab 64 may be formed from or attached to front foot 35 of front column 22. Vertical locking tab 64 includes a hole 65 that is designed to mate with hole 59 on web 57 of vertical support leg 56. It will be understood by those of skill in the art that vertical locking tab 64 is spaced from front column 22 the same distance as vertical support leg 56 such that the web 57 of support leg 56 mates with vertical locking tab 64.

Rear column 24 is provided with a horizontal locking tab 60 (see FIG. 9) that opposes horizontal locking tab 60 on front column 22. The horizontal locking tab 60 on rear column 24 also includes a vertical flange 61 attached to inside web 21 of front column 24 and a horizontal flange 62. A hole 66 is provided on horizontal flange 62 that is designed to align with hole 55 on the rear end of stiffening beam 51.

Horizontal stiffening member 51 is installed by placing the front end on horizontal locking tab 60 and bolting them together through holes 54 of stiffening member 51 and holes 63 of horizontal locking tab 60. Similarly, the rear end of horizontal stiffening member 51 is placed on horizontal locking tab 60 which is then bolted through holes 55 and 66. Vertical support leg 56 is bolted to vertical locking tab 64 through its holes 65 and hole 59 on the web 57 of vertical support leg 56. In addition to providing extra strength to prevent abuse to the lower front column 22, when vertical support leg 56 is attached to vertical locking tab 64, the front 22 and rear 24 columns are brought into proper vertical alignment. Thus, the present inventions also provide a means for self-alignment of the truss columns 22 and 24 during assembly.

Figure 9:
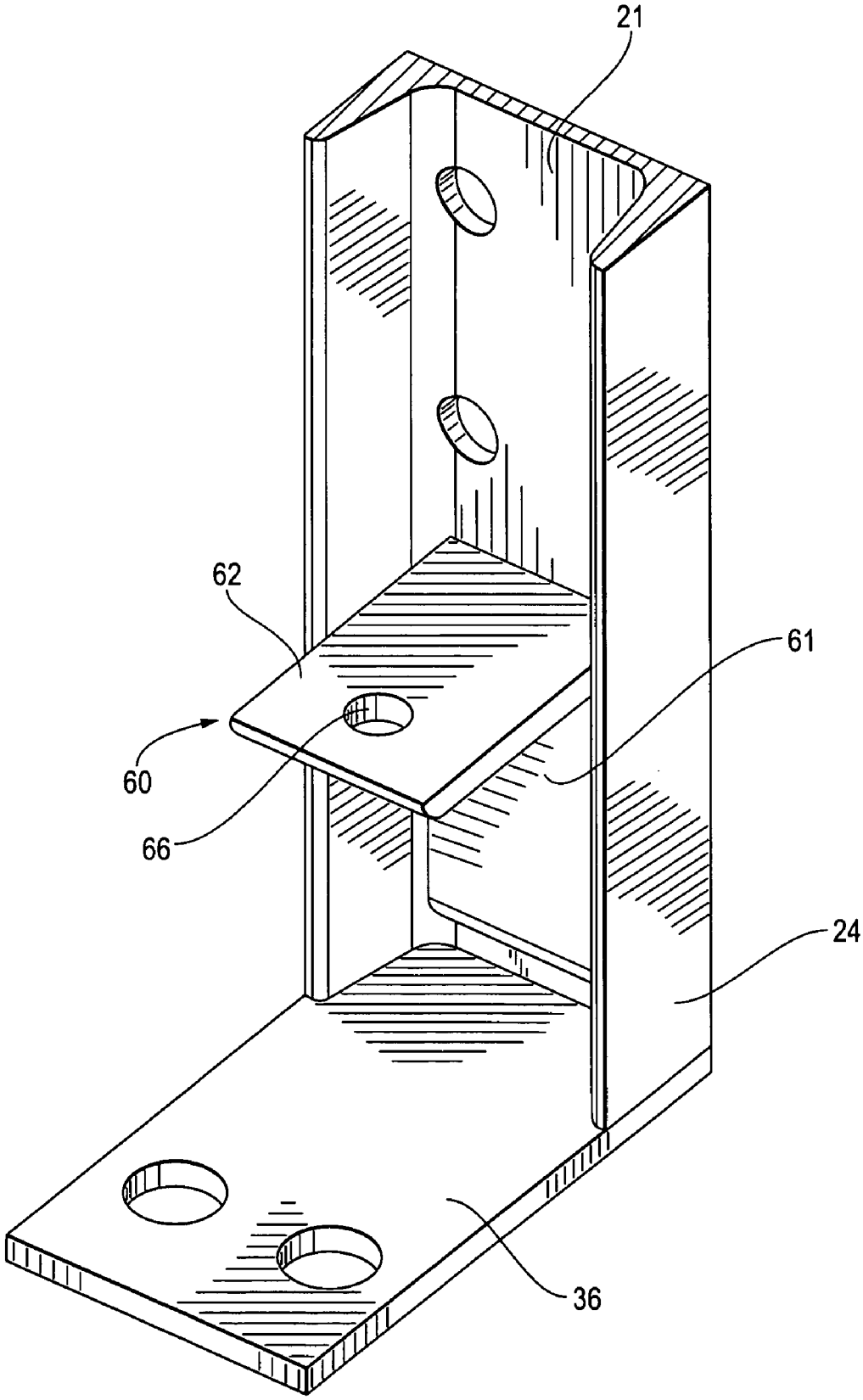
FIG. 9 is a rear perspective view of the rear portion of a preferred embodiment of the truss reinforcement of the present invention.
Figure 10:
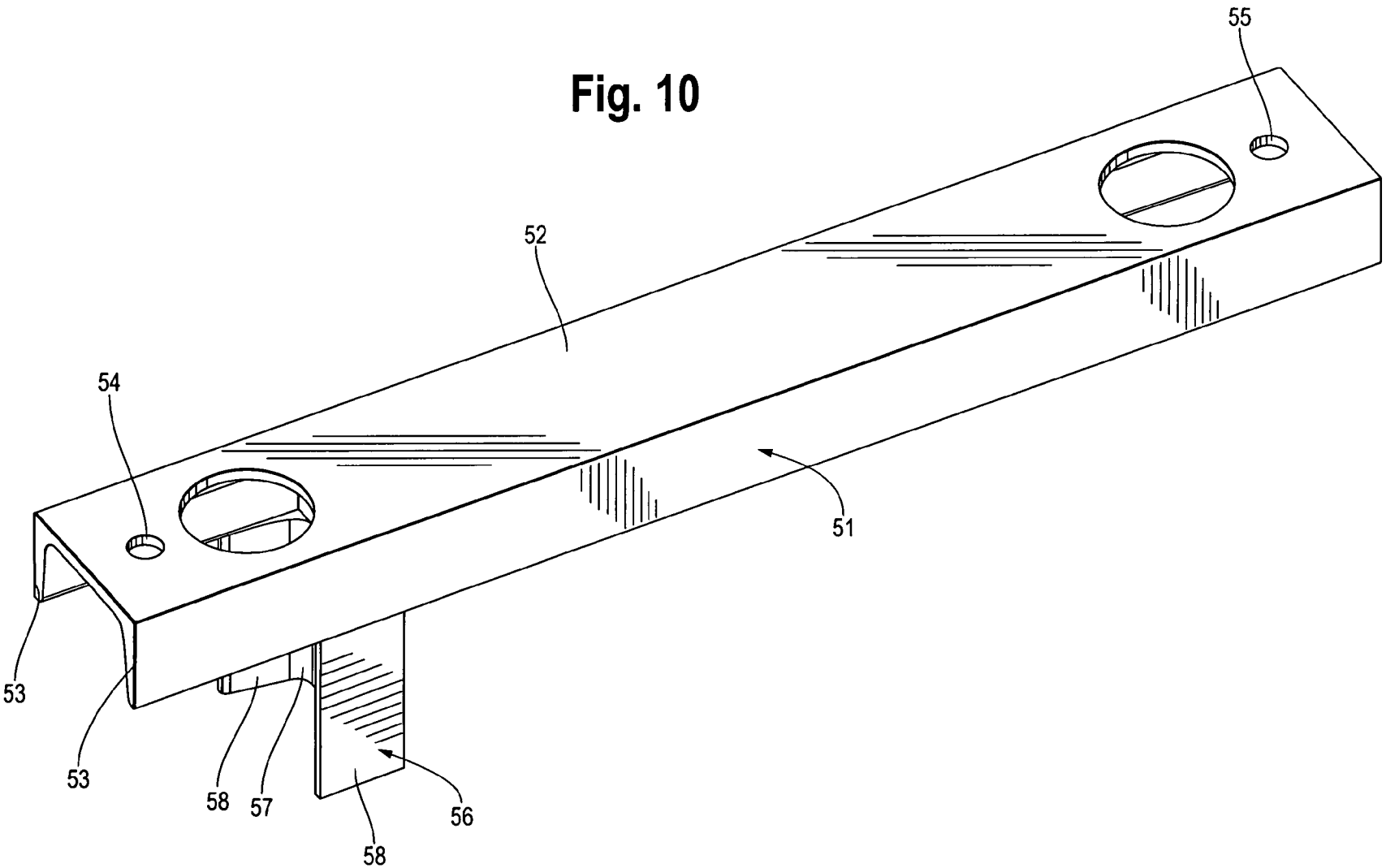
FIG. 10 is a side perspective view of a preferred transverse reinforcement beam of a preferred embodiment of the truss reinforcement of the present invention.

In an alternative embodiment of truss reinforcement 50, the lower portion of front column 22 is provided with the same components as rear column 24, as shown in FIG. 9. Specifically, like rear column 24, front column 22 is provided with a horizontal locking tab 60 having a bolt hole 66. In this embodiment, horizontal stiffening member 50 does not require a vertical support leg 58 or a vertical locking tab 64. Thus, horizontal stiffening member 51 is installed between the columns 22 and 24 and bolted at each end to horizontal locking tab 60. This embodiment is particularly useful in, but not limited to, drive-in rack systems.

It will be understood by those of skill in the art that the truss reinforcement inventions 50 may be practiced using a wide variety of structural members other than the types of members shown in the preferred embodiment. In addition, a vertical support leg 56 and a vertical locking tab 64 may be provided on the rear end of stiffening beam 51 and rear column 24. Such an arrangement, while acceptable, is not generally preferred because most of the abuse during loading and unloading occurs to the lower portion of front column 22.

The above description is not intended to limit the meaning of the words used in or the scope of the following claims that define the invention. Rather, it is contemplated that future modifications in structure, function or result will exist that are not substantial changes and that all such insubstantial changes in what is claimed are intended to be covered by the claims. Thus, while preferred embodiments of the present inventions have been illustrated and described, it will be understood that changes and modifications can be made without departing from the claimed invention.

Various features of the present inventions are set forth in the following claims.

What is claimed is:

1. A truss for use in forming storage racks comprising:

at least one front column having an interior face with a longitudinal center line and at least one rear column having an opposing interior face with a longitudinal center line;

a foot secured to a lower portion of the front column for placement on a warehouse floor;

a plurality of discrete stubs, each stub having a vertically oriented member, each said stub secured to the interior face of the front column such that said vertically oriented member is substantially along the center line of said front column;

a plurality of discrete stubs, each stub having a vertically oriented member, each said stub secured to the interior of the rear column such that said vertically oriented member is substantially along the center line of said rear column, the stubs on the front and rear columns opposing each other;

a plurality of transverse beams, each having a front and back end which are placed between the front and rear columns, the front end of which is bolted to the vertically oriented member of said stub on the front column and the rear end of which is bolted to the opposing vertically oriented member of said stub on the rear column;

a horizontal locking tab secured to the inside face of a lower portion of the front column;

a vertical locking tab spaced rearwardly from said front column, said locking tab attached to and vertically upstanding from said foot;

a horizontal locking tab secured to the inside face of a lower portion of the rear column;

a horizontal stiffening member including a front end and a rear end, the front end of said stiffening member having a downwardly projecting vertical support leg spaced rearwardly from the front end, wherein the front end of the horizontal stiffening member is capable of being bolted to the horizontal locking tab of the front column, the rear end of said stiffening member is capable of being bolted to the horizontal locking tab on the rear column, and the vertical support leg of said stiffening member is capable of being bolted to the vertically upstanding locking tab.

2. The truss of claim 1 wherein the stub may be removably secured to said columns.

3. The truss of claim 1 wherein the stub is formed from a structural plate.

4. The truss of claim 1 wherein the foot is formed from a structural plate.

* * * * *